US007999744B2

(12) United States Patent
Chin et al.

(10) Patent No.: US 7,999,744 B2
(45) Date of Patent: Aug. 16, 2011

(54) WIDEBAND PATCH ANTENNA

(75) Inventors: Ching Hong Chin, Hong Kong (CN); Quan Xue, Hong Kong (CN); Hang Wong, Hong Kong (CN); Xiu Yin Zhang, Hong Kong (CN)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 11/953,210

(22) Filed: Dec. 10, 2007

(65) Prior Publication Data

US 2009/0146883 A1 Jun. 11, 2009

(51) Int. Cl.
*H01Q 1/38* (2006.01)

(52) U.S. Cl. ..... 343/700 MS; 343/846

(58) Field of Classification Search ..... 343/700 MS, 343/846, 850

See application file for complete search history.

(56) References Cited

U.S. PATENT DOCUMENTS

| | | | | |
|---|---|---|---|---|
| 4,907,006 | A * | 3/1990 | Nishikawa et al. | 343/700 MS |
| 4,973,972 | A * | 11/1990 | Huang | 343/700 MS |
| 6,317,084 | B1 * | 11/2001 | Chen et al. | 343/700 MS |
| 6,883,227 | B2 * | 4/2005 | Lebaric et al. | 29/600 |
| 7,148,847 | B2 * | 12/2006 | Yuanzhu | 343/700 MS |
| 7,304,611 | B2 * | 12/2007 | Yuanzhu | 343/700 MS |
| 2003/0122716 | A1 * | 7/2003 | Ellis et al. | 343/702 |
| 2004/0150566 | A1 * | 8/2004 | Yuanzhu | 343/700 MS |
| 2005/0052323 | A1 * | 3/2005 | Shikata | 343/700 MS |
| 2006/0170593 | A1 * | 8/2006 | Watts | 343/700 MS |
| 2006/0176233 | A1 * | 8/2006 | Tang et al. | 343/850 |
| 2008/0122717 | A1 * | 5/2008 | Su et al. | 343/787 |

OTHER PUBLICATIONS

Vandenbosch, Guy A. E., et al., "Study of the capacitively fed microstrip antenna element", IEEE Transactions on Antennas and Propagation, 42(12): 1648-1652 (1994).

Zharig, Xiu Yin, et al., "A wideband antenna with dual printed L-probes for cross-polarization suppression", IEEE Antennas and Wireless Propagation Letters, 5:388-390 (2006).

Lee, K. F., et al., "Experimental and simulation studies of the coaxially fed U-slot rectangular patch antenna", IEE Proc.—Micro. Antennas Propag., 144(5):354-358 (1997).

* cited by examiner

*Primary Examiner* — HoangAnh T Le

(74) *Attorney, Agent, or Firm* — Leydig, Voit & Mayer, Ltd.

(57) ABSTRACT

A patch antenna has a ground plane and a planar antenna plate that are parallel to and spaced from each other. A pair of planar feed plates have feed edges electrically contacting a surface of the antenna plate to couple electromagnetic energy into and/or out of the antenna plate.

5 Claims, 9 Drawing Sheets

1.37 GHz
E- Plane Co-polar 1.78 GHz
E- Plane Co-polar 2.37 GHz
E- Plane Co-polar 2.97 GHz
E- Plane Co-polar 1.37 GHz
E- Plane Cross-polar 1.78 GHz
E- Plane Cross-polar 2.37 GHz
E- Plane Cross-polar 2.97 GHz
E- Plane Cross-polar 1.37 GHz
H- Plane Co-polar 1.78 GHz
H- Plane Co-polar 2.37 GHz
H- Plane Co-polar 2.97 GHz
H- Plane Co-polar 1.37 GHz
H- Plane Cross-polar 1.78 GHz
H- Plane Cross-polar 2.37 GHz
H- Plane Cross-polar 2.97 GHz
H- Plane Cross-polar

WIDEBAND PATCH ANTENNA

BACKGROUND OF THE INVENTION

1. Field of the Invention

The invention relates to antennas, and in particular to patch antennas.

2. Background Information

Patch antennas are very popular because they are simple and cheap to fabricate, easy to modify and customize for a variety of applications, and are light weight and have a low profile so are easily concealed on or within a device. A simple patch antenna comprises a planar metal antenna plate (patch) suspended above a larger ground plane. Typically the patch is a half-wavelength long. The antenna signal is carried on a feed wire attached to the patch along one edge. A simple patch antenna of this type can be fabricated on a dielectric substrate employing similar lithographic printing techniques as those used to fabricate printed circuit boards. Despite their numerous benefits and wide use, patch antennas have a number of drawbacks including narrow bandwidth, low efficiency and low power handling capability.

The huge growth of wireless communications has necessitated the development of bandwidth boosting techniques over recent years. With the widespread exploitation of thick substrate, various bandwidth enhancement techniques, such as U-slotted patch

[Lee, K. F., Luk, K. M., Tong, K. F, Shum, S., Huyunh, M. T., and Lee, R. Q.: '*Experimental and simulation studies of coaxially fed U-slot rectangular patch antenna*'. *IEE Proc., Microw. Antennas Propag.,* 1997, 144, (5), pp. 354-358], capacitive feed [Vandenbosch, G. A. E., and Capelle, A. R. V: '*Study of the capacitively fed microstrip antenna element*', *IEEE Trans. Antennas Propag.,* 1994, AP-42, (12), pp. 1648-1652], and L-shaped probe feed [Mak, C. L., Luk, K. M., Lee, K. F., and Chow, Y. L.: '*Experimental study of a microstrip patch antenna with an L-shaped probe*', *IEEE Trans. Antennas Propag.,* 2000, AP-48, (5), pp. 777-783], have been proposed which achieve substantial increases in impedance bandwidths of more than 30%, but suffer from various problems including high-cross polarization, inconsistent gain and unstable radiation patterns. A differential feed L-probe patch antenna has been proposed [Ref: X. Y. Zhang, Q. Xue, B. J. Hu, and S. L. Xie, "*A wideband antenna with dual printed L-probes for cross-polarization suppression,*" *IEEE Antennas and Wireless Propagation Letters*, vol. 5, pp. 388-390, February 2006] that can achieve 45% bandwidth impedance and low cross polarization. The impedance bandwidth of the differential feed L-probe patch antenna is wide enough to serve various wireless communications systems. However, there exists a need for a wider impedance bandwidth.

Accordingly, it is an object of the present invention to provide a patch antenna which overcomes or at least ameliorates at least one or more of the problems with known patch antennas. It is a further object of the present invention to provide a patch antenna which is suitable, or at least more suitable than known patch antennas, for use in a various wireless communications device and differential-fed antennas.

SUMMARY OF THE INVENTION

There is disclosed herein a differential-fed patch antenna having a folded pair of plates as the differential feed to the antenna plate.

A patch antenna has a ground plane and a planar antenna plate positioned in parallel at a distance from each other. A wideband impedance matching means connected with the antenna plate for coupling electromagnetic energy into and/or out of the antenna plate comprises one or more planer feed plates having a feed edge and located perpendicular to the antenna plate with the feed edge electrically contacting a surface of the antenna plate along a non-resonant direction of the antenna plate. The feed plates can be L-shaped with a first part perpendicular to the antenna plate and having the edge electrically contacting the surface of the antenna plate, and a second part parallel to the antenna plate. Ideally there is a pair planer feed plates each having a feed edge and located perpendicular to the antenna plate with the feed edge electrically contacting the surface of the antenna plate.

Further aspects of the invention will become apparent from the following description and the claims.

BRIEF DESCRIPTION OF THE DRAWINGS

An exemplary form of the present invention will now be described by way of example only and with reference to the accompanying drawings, in which.

DETAILED DESCRIPTION OF THE EXEMPLARY EMBODIMENTS

Figure 1:
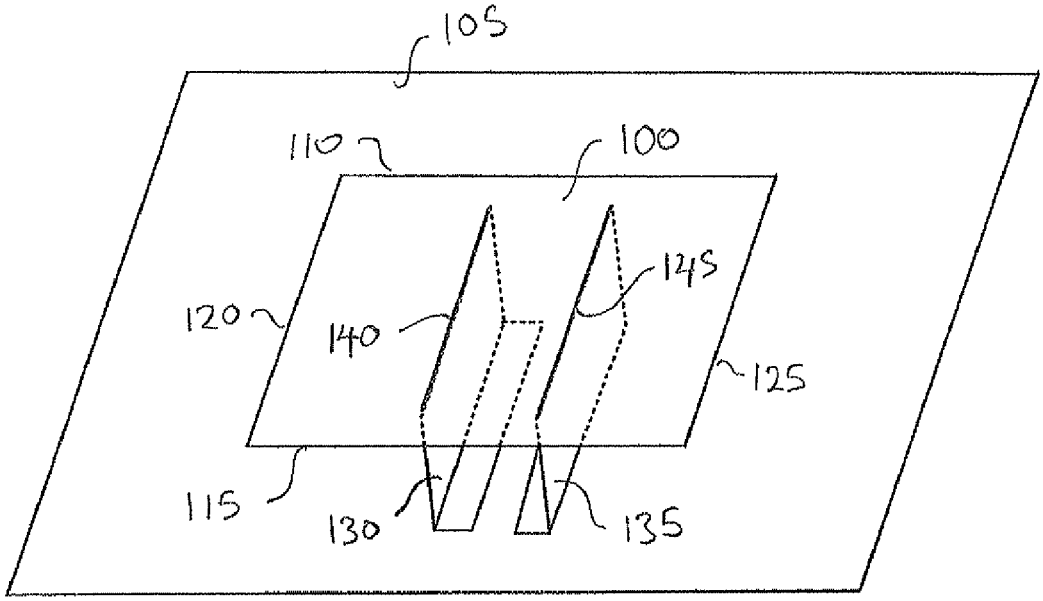
FIG. 1 is a perspective schematic illustration of a differential-fed patch antenna according to the invention.
Figure 5:
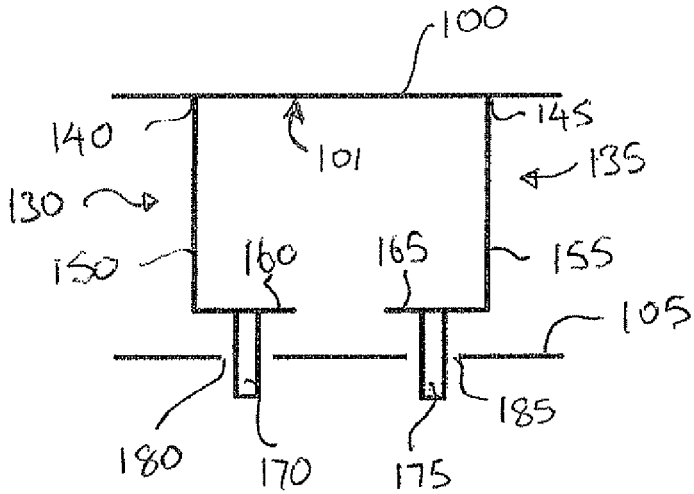
FIG. 5 is a schematic illustration of feed plates of the patch antenna.
Figure 2:
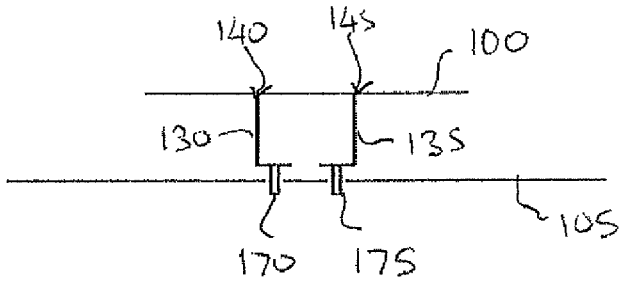
FIG. 2 is a schematic end illustration of the patch antenna.
Figure 3:
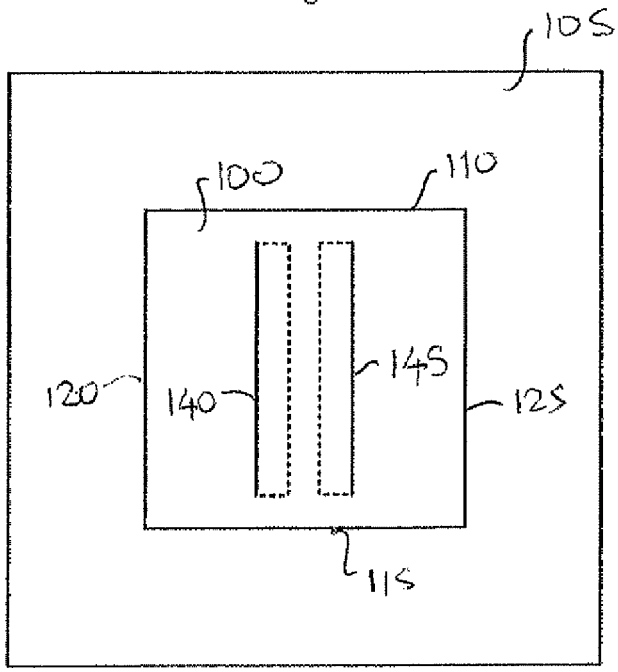
FIG. 3 is a schematic top illustration of the patch antenna.
Figure 4:
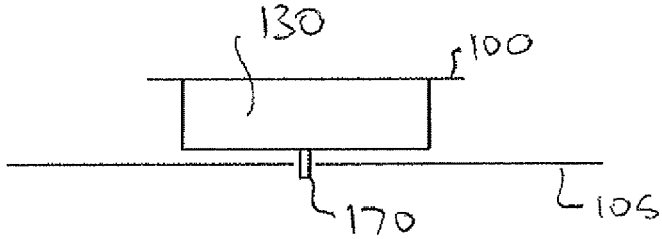
FIG. 4 is a schematic side illustration of the patch antenna.

The invention will now be illustrated as practiced in a broadband differential-fed patch antenna. The patch antenna has a pair of folded feed plates for feeding the differential signal to the antenna plate. The feeding plates act as a wideband impedance matching device for the antenna plate, resulting in an antenna with a wide impedance bandwidth. The differential feeding arrangement suppresses any unwanted radiation from the feeding plates, but is essential to the invention and in one embodiment of the invention is a single feed antenna. This makes for the low cross-polarization levels within the operating band. The vertical feeding plate pair, together with the differential feeding arrangement gives the antenna a stable and symmetrical radiation pattern within the operating bandwidth resulting in stable antenna gain over the operating bandwidth. Test results show that the antenna can achieve an impedance bandwidth of up to 74% at a standing wave ratio (SWR) of less than 2, together with a symmetric radiation pattern, low-cross polarization level and stable radiation pattern in its design band.

Referring to FIGS. 1-5 there is shown an embodiment of a patch antenna according to the invention comprising a planar antenna plate 100 suspended above a larger ground plane 105. The antenna plate 100 is typically rectangular in shape, having a lengthwise, i.e., non-resonant, direction between its two ends 110, 115. The dimension of the antenna plate 100, lengthwise, i.e., between the ends 110, 115, is greater than its widthwise dimension between its two sides 120, 125. The theoretical widthwise dimension between sides 120, 125 of the antenna plate 100 is approximately half its intended design center wavelength (λo). The physical width of the antenna plate 100 is in fact slightly shorter than this theoretical length due to fringing fields and can be approximated to 0.43 times the design center wavelength λo. The antenna plate 100 is suspended above the ground plane 105 by spacers (not shown). The dielectric material between the antenna plate 100 and ground plane 105 is air. The ground plane 105 is larger than the antenna plate 100, but in practice may be only slightly larger and is typically square. The center of the antenna plate 100 is aligned with the center of the ground plane 105 resulting in a symmetrical configuration with reference to both the x and y-axes.

Attached to the face 101 of the antenna plate 100 that is facing the ground plane 105 is a pair of L-shaped feed plates 130, 135. The feed plates 130, 135 have spaced apart feed edges 140, 145 that are electrically connected to the antenna plate 100, by soldering or like method, to couple electromagnetic energy into and/or out of the antenna plate 100. The feed plates 130, 135 are attached to the antenna plate symmetrically about a center-line along the lengthwise, i.e., non-resonant, direction of the plate from first end 110 to second end 115. The L-shaped feed plates 130, 135 each have a first vertical part 150, 155 extending downwardly perpendicular to the antenna plate 100 and a second horizontal part 160, 165 extending perpendicular to vertical parts 150, 155, and thus parallel to the plane of the antenna plate 100. In the illustrated embodiment horizontal parts 160, 165 of the L-shaped feed plates extend towards each other, however this is not essential to the invention and the horizontal parts 160, 165 may extend in the opposite direct with the same results. There is a gap between the two horizontal parts 160, 165 of the feed plates. A pair of signal feed probes 170, 175 are located centrally on respective ones of the horizontal parts 160, 165 of the feed plates and extend downwardly through openings 180, 185 in the ground plane 105. For an antenna integral with a portable device the feed probes may be a conductor of feed-lines (not shown) connecting the antenna with a radio transmitter and/or receiver circuit (not shown). If the antenna is an external antenna the feed probes 170, 175 may comprise a pair of coaxial connectors to provide a connection point for an RF cable. The entire antenna arrangement can be contained within a plastic radome (not shown) to protect the structure from damage and provide an aesthetic antenna package.

Figure 6:
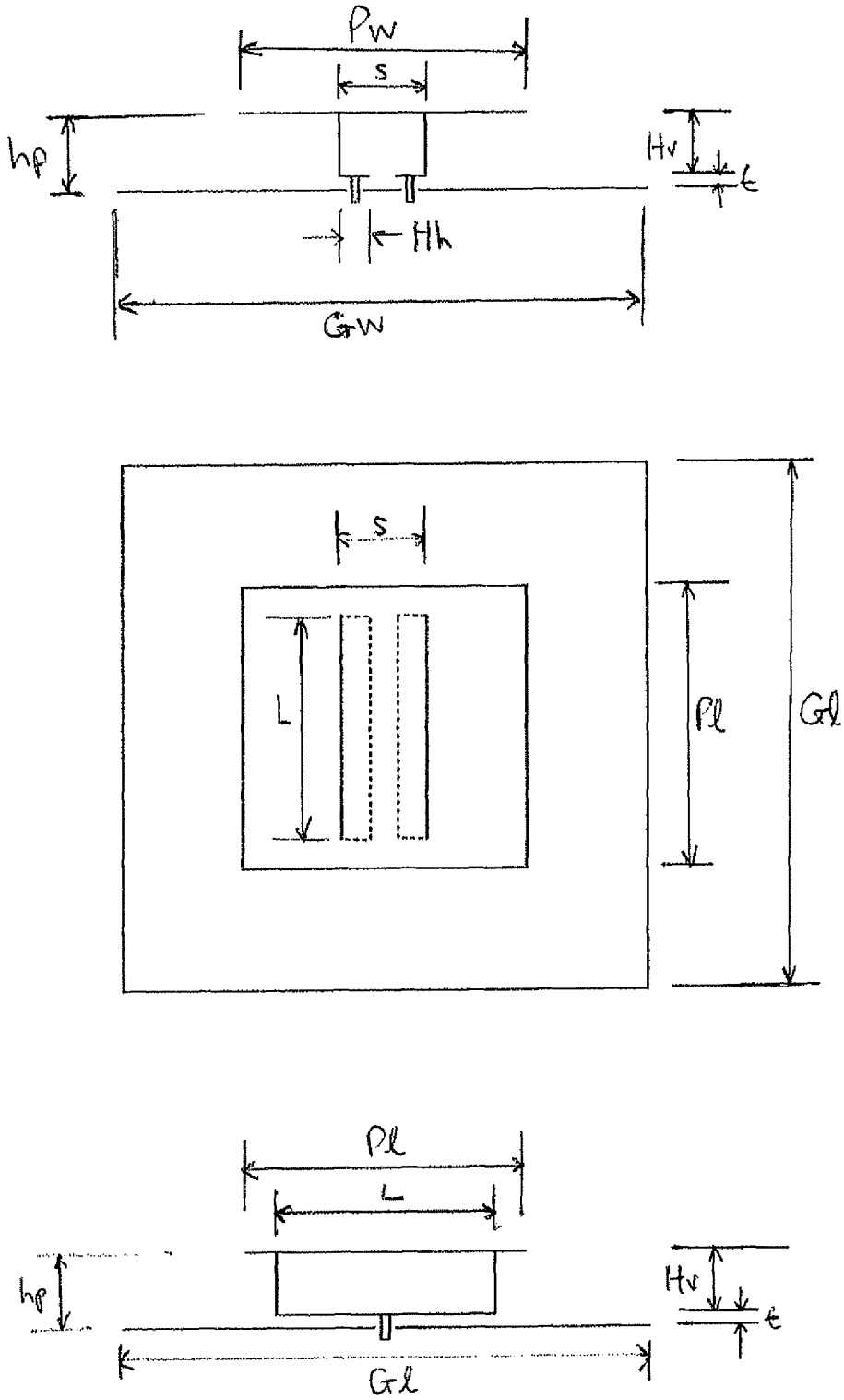
FIG. 6 shows dimensional characteristics for the antenna illustrated in FIGS. 2, 3 and 4, respectively, designed for a center frequency of 2.17 GHz.

The size of the antenna plate 105 and other dimensions of the patch antenna are established around a design frequency. FIG. 6 illustrates the dimensional characteristics of a test antenna designed for a center frequency (fo) of 2.17 GHz (center wavelength (λo) of 138.25 mm). The dimensions are:

Pl=length of antenna plate=68 mm (0.49λo)

Pw=width of antenna plate=60 mm (0.43λo)

Gl=length of ground plane=250 mm (1.8λo)

Gw=width of ground plane=250 mm (1.8λo)

hp=distance between antenna plate and ground plane=16 mm (0.1λo)

L=length of feeding edge of the feed plates=43 mm (0.31λo)

Hv=width of vertical part of feed plate=13.5 mm (0.098λo)

Hh=width of horizontal part of feed plate=7.5 mm (0.054λo)

s=separation between the feeding edges of feed plates=26 mm (0.188λo)

g=separation between the horizontal parts of feed plate=s−(2×WH)= t=separation between the horizontal parts of feed plate and ground plane=2.5 mm (0.018λo)

d=separation between the SMA coaxial connectors=20 mm (0.14 λo)

Figure 7:
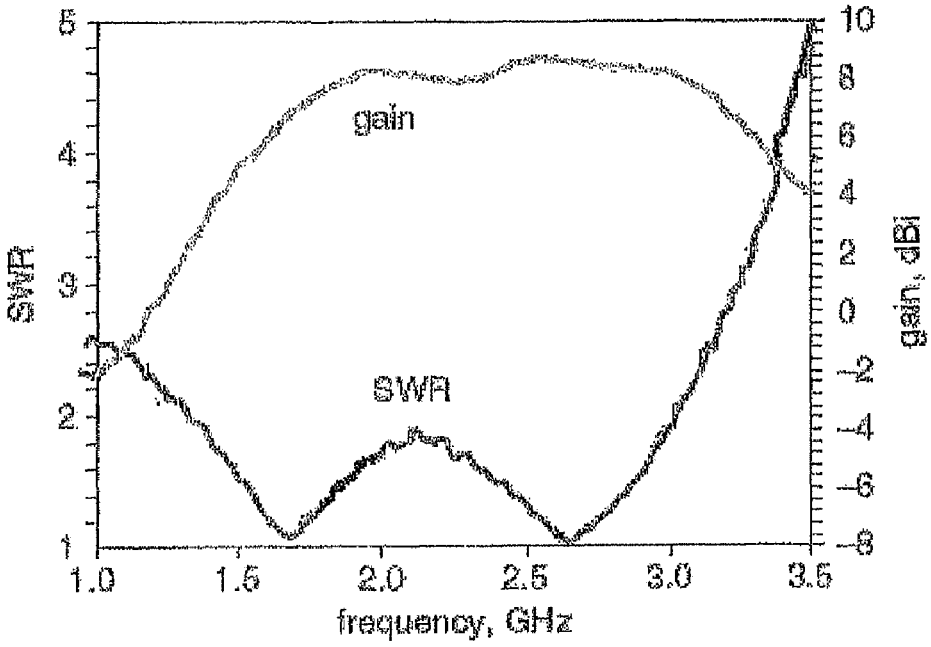
FIG. 7 is a graph of standing wave ratio and gain versus frequency for the test antenna.

The feed probes are connected to a pair of 50-ohm subminiature A (SMA) coaxial connecters. The test antenna was feed with a differential signal from a wideband 180-degree power divider that transforms a single-ended signal into a pair of differential (out-of-phase) signals. The output of the diverter was connected to SMA coaxial connecters by coaxial cables. A HP8510C network analyzer and a compact antenna test range with an HP85103C antenna measurement system were used to measure the standing-wave ratio (SWR), radiation pattern and gain of the test antenna. The results are shown in FIGS. 7-11. FIG. 7 shows that the test antenna has an operating band of 1.37 GHz to 2.97 GHz with a measured impedance bandwidth of 74% at a SWR of less than 2. The gain of the antenna is stable at about 8.5 dBi over the operating band. FIGS. 8 through 11 illustrates measured radiation patterns of the antenna at 1.37, 1.97 2.37 and 2.97 GHz. It can be seen that the measured cross-polarization levels are around 20 dB lower than the co-polarization levels. Cross-polarization in both E-plane and H-plane cannot be observed, as it is vanishingly small across the operating band under ideal conditions. In addition, taking advantage of the structure symmetry, the co-polarization radiation patterns in both E-plane and H-plane are symmetric with respect to the broadside direction within the band. Moreover, the back lobe radiation levels are less than −15 dB. This kind of antennas can serve as base station antenna for many wireless communication systems, for example, GSM, CDMA, PCS, WCDMA, WLAN, and GPS.

Figure 12:
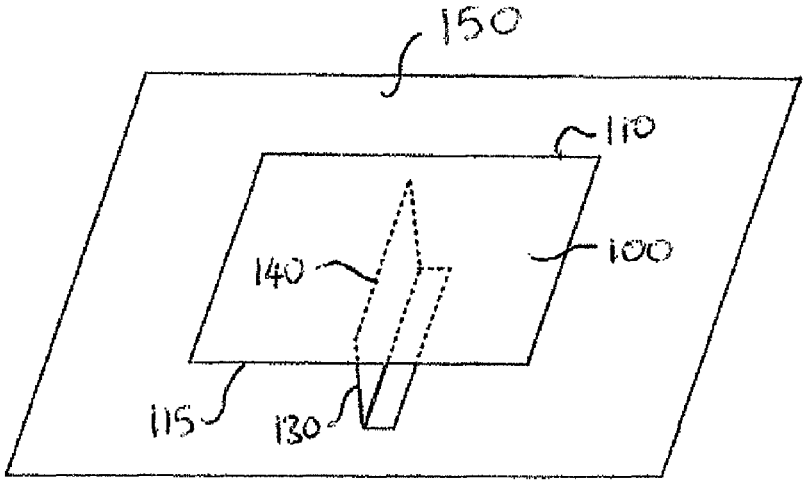
FIG. 12 is a perspective schematic illustration of a single feed patch antenna according to the invention.
Figure 8:
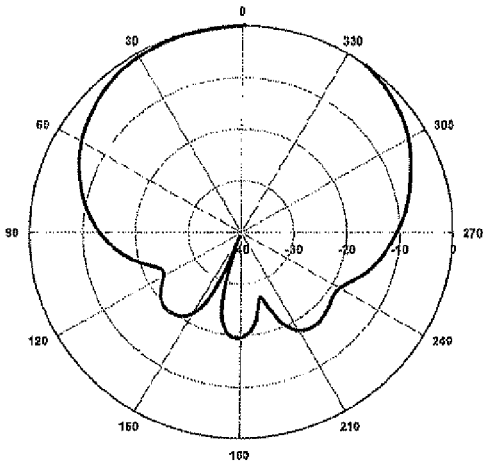
FIG. 8 is plots of measured E plane co-polarization radiation pattern of the test antenna at 1.37, 1.78, 2.37 and 2.97 GHz frequencies.
Figure 8:
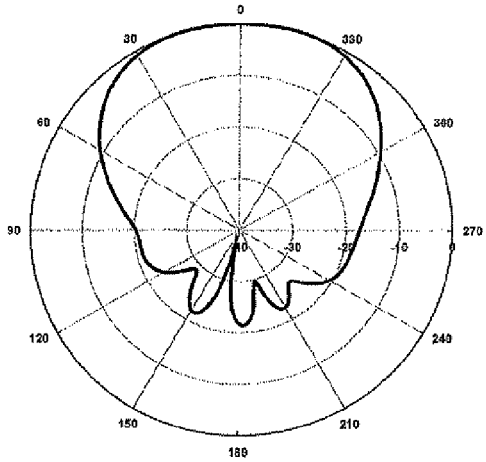
Figure 8:
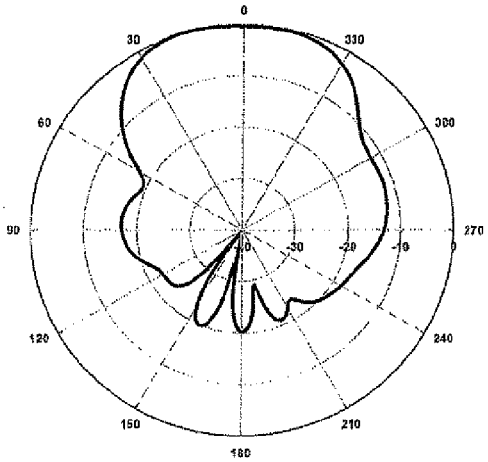
Figure 8:
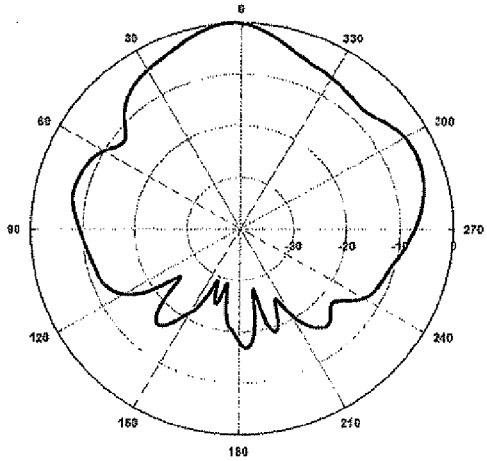
Figure 9:
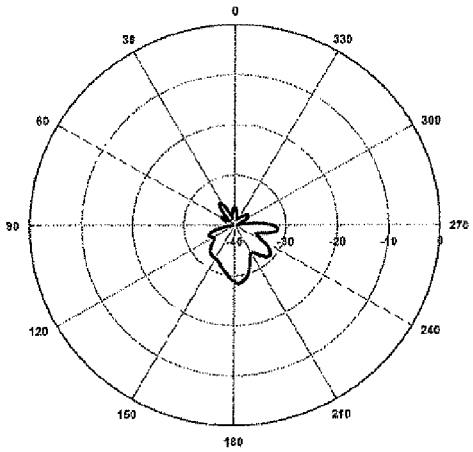
FIG. 9 is plots of measured E plane cross-polarization radiation pattern of the test antenna at 1.37, 1.78, 2.37 and 2.97 GHz frequencies.
Figure 9:
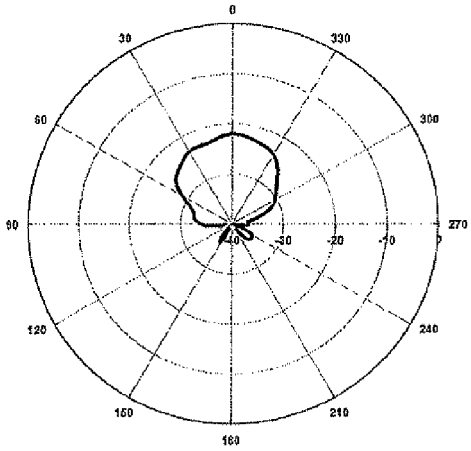
Figure 9:
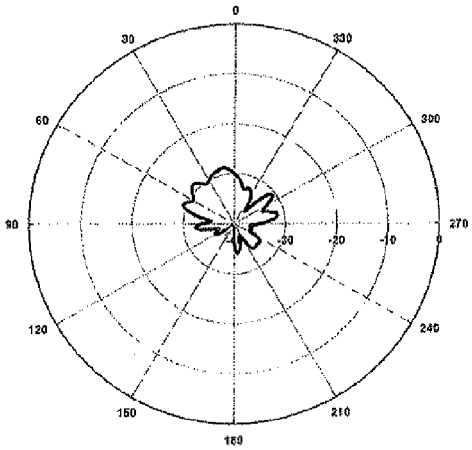
Figure 9:
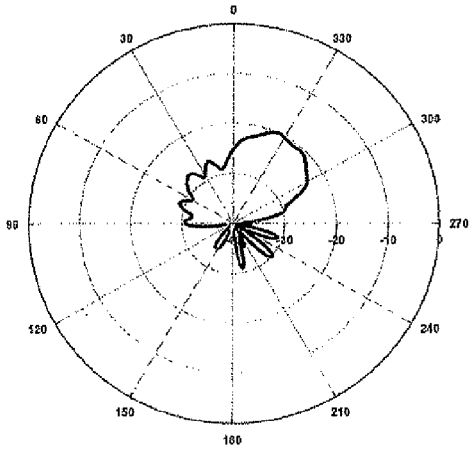
Figure 10:
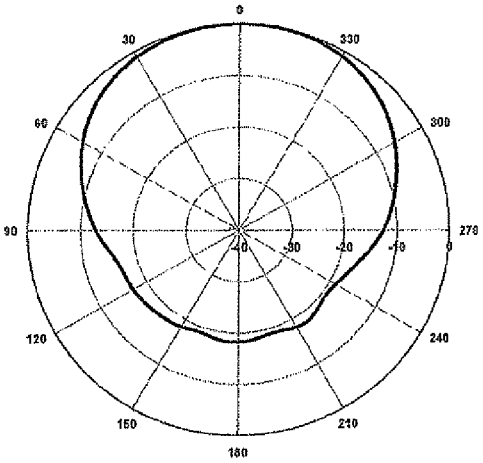
FIG. 10 is plots of measured H plane co-polarization radiation pattern of the test antenna at 1.37, 1.78, 2.37 and 2.97 GHz frequencies.
Figure 10:
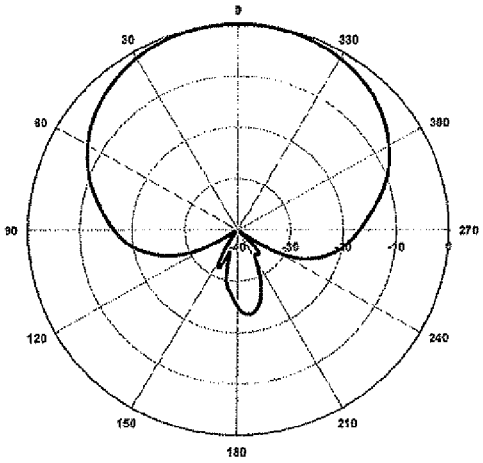
Figure 10:
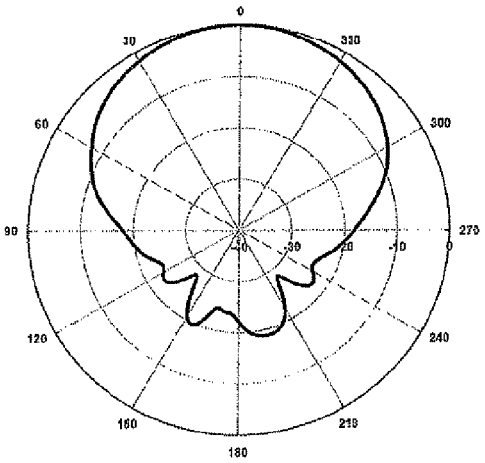
Figure 10:
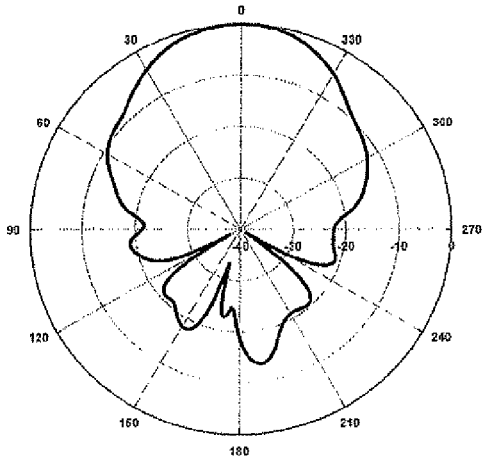
Figure 11:
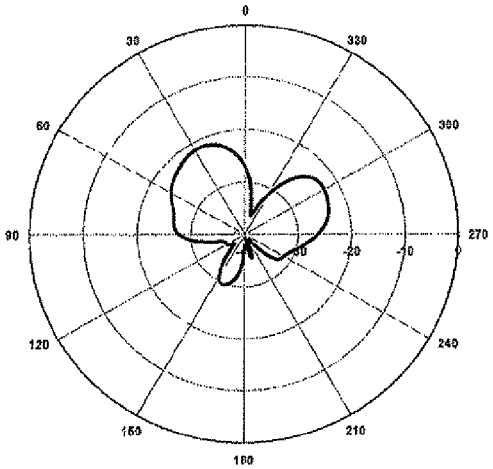
FIG. 11 is plots of measured H plane cross-polarization radiation pattern of the test antenna at 1.37, 1.78, 2.37 and 2.97 GHz frequencies.
Figure 11:
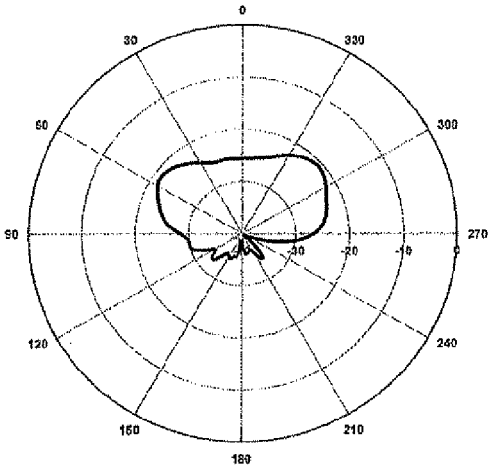
Figure 11:
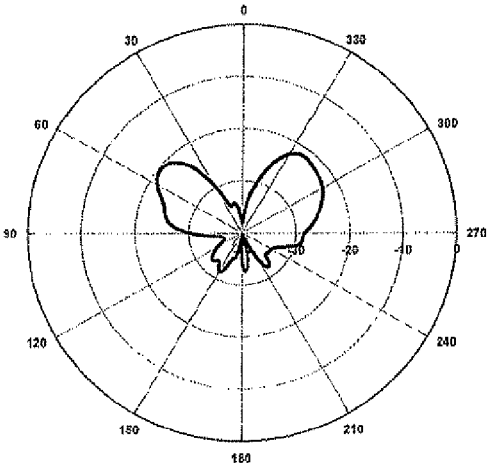
Figure 11:
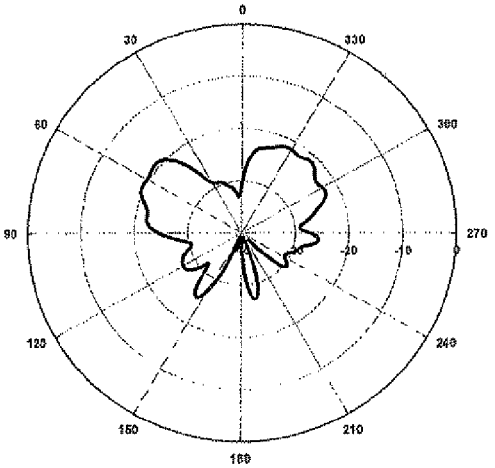

It should be appreciated that modifications and alternations obvious to those skilled in the art are not to be considered as beyond the scope of the present invention. For example, the feed plates 130, 135 are L-shaped each having a first vertical part 150, 155 and a second horizontal part 160, 165. The horizontal part 160, 165 is however not critical to the invention and in an alternative embodiment the feed plates may comprise just the first vertical parts 150, 155 with the feed wires connected directly to a lower edge of the vertical parts 150, 155. Also, for a single feed antenna there may be only one feed plate as illustrated in FIG. 12. The single feed antenna is similar to the differential feed antenna of FIGS. 1 through 6, but only has a single L-shaped feed pate 130 along a center-line of the plate in the lengthwise direction from first end 110 to second end 115.

Figure 13:
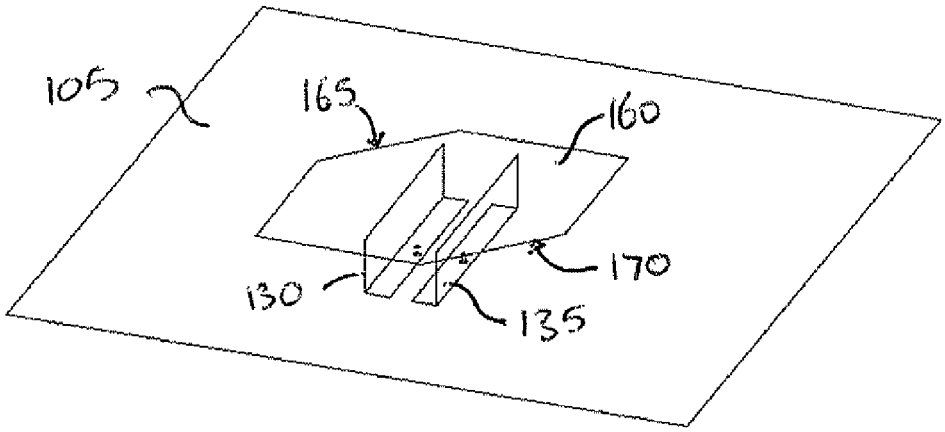
FIG. 13 is a perspective schematic illustration of a truncated corner patch antenna according to the invention.
Figure 14:
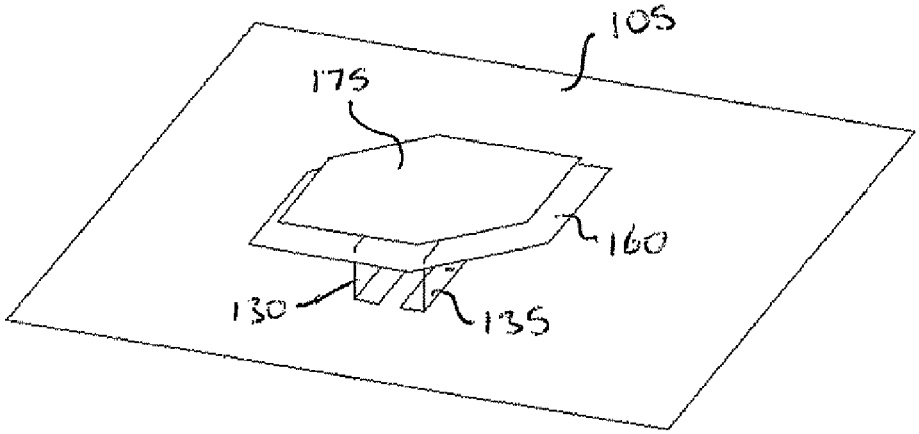
FIG. 14 is a perspective schematic illustration of a stacked truncated corner patch antenna according to the invention.

The invention can also be implemented in a Circularly-Polarized Patch Antenna by cutting two corners off the antenna plate to make a truncated patch as shown in FIG. 13. The configuration is the same as the differential feed antenna of FIGS. 1 through 6, but the patch 160 has truncated corners 165 and 170. This type of antenna is widely used in GPS applications. The invention can also be practiced in a stacked patch antenna as illustrated in FIG. 14 in which a second antenna plate 175 is stacked on the first antenna plate. The illustrated stacked antenna is a truncated patch type, but may be a regular square type as illustrated in FIGS. 1 through 6.

What is claimed is:

1. A patch antenna comprising:

a planar antenna plate having a resonant direction and a non-resonant direction transverse to the resonant direction, a ground plane opposite and electrically isolated and separated from the planar antenna plate by air, and a wideband impedance matching structure disposed between the planar antenna plate and the ground plane, connected to the antenna plate, and coupling electromagnetic energy into and out of the antenna plate, wherein the wideband impedance matching structure comprises a pair of feed plates, the feed plates being symmetrically positioned with respect to a centerline of the antenna plate, each feed plate being perpendicular to the antenna plate and having a respective feed edge electrically contacting the antenna plate, and extending along the non-resonant direction of the antenna plate.

2. The patch antenna of claim 1 wherein the feed plates are L-shaped and each feed plate comprises a first part that is perpendicular to the antenna plate and includes the feed edge, and a second part that is parallel to the antenna plate, and the feed plates are located in a complementary arrangement, with the second parts of the feed plates extending towards each other.

3. A patch antenna comprising:

a ground plane, a planar antenna plate having a width, a length extending along a non-resonant direction of the antenna plate, and a surface, the antenna plate being positioned at a distance from the ground plane, with the surface facing the ground plane, wherein the planar antenna plate is electrically isolated and separated from the ground plane by air, and a pair of feed plates, each feed plate having a width, a length, and a feed edge along the length, the feed plates being perpendicular to the antenna plate and symmetrically located with respect to a centerline of the antenna plate, the centerline being substantially parallel to the non-resonant direction, with the feed edges electrically contacting the surface of the antenna plate and extending along the non-resonant direction.

4. The antenna of claim 3 designed to operate at a center wavelength $\lambda o$, wherein the length of the antenna plate is $0.49\lambda o$, the width of the antenna plate is $0.43\lambda o$, the distance between the antenna plate and the ground plane is $0.11\lambda o$, the length of each of the feed plates is $0.31\lambda o$, the width of the feed plate is $0.098\lambda o$, and separation between the feed edges of feed plates is $0.188\lambda o$.

5. The patch antenna of claim 3 wherein the feed plates are L-shaped and each feed plate comprises a first part that is perpendicular to the antenna plate and includes the feed edge, and a second part that is parallel to the antenna plate, and the feed plates are located in a complementary arrangement with the second parts of the feed plates extending towards each other.

* * * * *